US005282835A

United States Patent [19]

Wright et al.

[11] Patent Number: 5,282,835

[45] Date of Patent: Feb. 1, 1994

[54] EXERCISING TABLE FOR APPLYING CYCLIC MOVEMENT WITH ADJUSTABLE SUPPORT MEMBERS

[76] Inventors: Howard S. Wright, 436 Devon Street West, New Plymouth; Robin A. McKenzie, 8 Parata Street, Waikanae, both of New Zealand

[21] Appl. No.: 875,283

[22] Filed: Apr. 28, 1992

[30] Foreign Application Priority Data

Mar. 4, 1992 [NZ] New Zealand ..... 241836

[51] Int. Cl.[5] ..... A61H 1/02

[52] U.S. Cl. ..... 606/242; 606/243; 606/245; 128/25 R; 5/613; 5/616

[58] Field of Search ..... 606/241-245; 5/608-610, 613, 616; 128/71, 75, 25 R; 482/901

[56] References Cited

U.S. PATENT DOCUMENTS

| | | | |
|---|---|---|---|
| 1,205,649 | 11/1916 | Miller | 606/241 |
| 1,286,184 | 11/1918 | McManis | 606/245 |
| 2,152,431 | 11/1936 | Jensen | 606/245 |
| 2,179,595 | 11/1939 | McManis | 606/245 |
| 2,598,204 | 5/1952 | Allen | 606/244 |
| 4,235,437 | 11/1980 | Ruis et al. | 482/901 |
| 4,379,450 | 4/1983 | Sjölinder | 606/243 |
| 4,847,929 | 7/1989 | Pupovic | 5/608 |
| 5,044,359 | 9/1991 | Reinert | 606/243 |
| 5,123,916 | 6/1992 | Riddle et al. | 606/242 |

*Primary Examiner*—Richard J. Apley
*Assistant Examiner*—Jeanne M. Mollo
*Attorney, Agent, or Firm*—Oblon, Spivak, McClelland, Maier & Neustadt

[57] ABSTRACT

An exercise machine for passive exercise of a patient. The machine has a patient support platform having first and second parts which are adapted to support the upper and lower parts of a patient's body. Mechanisms are provided for applying a cyclic movement to the first and second parts of the support platform. Supports are pivotally coupled to each of the first and second parts and adjustable whereby the position of the pivotal coupling of each support to the respective first and second parts can be individually adjusted relative to at least one reference plane.

16 Claims, 6 Drawing Sheets

BOLD FIGURES ABOVE HORIZONTAL *ITALIC FIGURES BELOW HORIZONTAL*

| | | | | | | | | | |
|---|---|---|---|---|---|---|---|---|---|
| 1 | 2<br>*17* | 1<br>*17* | **0**<br>*18* | **1**<br>*19* | **2**<br>*20* | **2**<br>*22* | **2**<br>*24* | **3**<br>*25* | MAX |
| 2 | **0**<br>*15* | **2**<br>*14* | **3**<br>*15* | **4**<br>*16* | **5**<br>*17* | **6**<br>*18* | **6**<br>*20* | **6**<br>*22* | FLEXION |
| 3 | **3**<br>*12* | **4**<br>*12* | **5**<br>*13* | **7**<br>*13* | **8**<br>*14* | **9**<br>*15* | **10**<br>*16* | **10**<br>*18* | |
| 4 | **5**<br>*10* | **6**<br>*10* | **8**<br>*10* | **10**<br>*10* | **11**<br>*11* | **12**<br>*12* | **13**<br>*13* | **14**<br>*14* | MIN |
| 5 | **8**<br>*7* | **8**<br>*8* | **10**<br>*8* | **13**<br>*7* | **14**<br>*8* | **16**<br>*8* | **16**<br>*10* | **18**<br>*10* | EXTENSION |
| 6 | **9**<br>*6* | **10**<br>*6* | **12**<br>*6* | **15**<br>*5* | **17**<br>*5* | **18**<br>*6* | **20**<br>*6* | **22**<br>*6* | |
| 7 | **11**<br>*4* | **12**<br>*4* | **15**<br>*3* | **17**<br>*3* | **20**<br>*2* | **22**<br>*2* | **24**<br>*2* | **26**<br>*2* | |
| 8 | **13**<br>*2* | **15**<br>*1* | **18**<br>*0* | **20**<br>*0* | **23**<br>*1* | **25**<br>*1* | **27**<br>*1* | **29**<br>*1* | MAX |
| | 15° | 16° | 18° | 20° | 22° | 24° | 26° | 28° | |

FIG. 8.

EXERCISING TABLE FOR APPLYING CYCLIC MOVEMENT WITH ADJUSTABLE SUPPORT MEMBERS

BACKGROUND OF THE INVENTION

Discussion of the Background

This invention relates to an exercise machine.

It is well known that when a human spinal disc is dislodged from its correct location and remains displaced for a period of time it calcifies, loses its flexibility and causes considerable pain. A treatment procedure that can be carried out by a therapist or by the sufferer himself is to repeatedly flex the spinal column in the same direction as the dislodged disc. When this spinal bending is carried out by a therapist it only takes place during short appointment periods.

Neither the treatment procedure of the therapist or the sufferer himself has met with much success because the treatment can not be sustained for long enough. On the one hand short appointment periods do not allow enough time for the therapy to be effective and on the other hand the muscular effort required limits the number of bending movements of which the patient is capable when carrying out an exercise program himself. It is also known that if the patient applies extension by his own effort pressure on the intra vertebral disc is raised. However, if the movement is provided without muscular effort the pressure is consequently lower and more beneficial.

It has now been found that if the spine is bent in the appropriate direction hundreds of times within a short time frame of several days the calcified cartilage material of the disc regains its suppleness and is able to return to its original location.

SUMMARY OF THE INVENTION

This concentrated treatment is not practical or possible without mechanical assistance. Accordingly it is the object of the present invention to provide an exercise machine which achieves this purpose.

The basic function of the exercise machine according to the present invention is to bend a patient's spinal column repeatedly to a degree that can be predetermined and controlled. The machine can thus provide cycles of end range passive exercise. Therefore in its preferred form the machine provides extension or flexion to the lumber spine from above or below, or a combination of both is possible.

Accordingly in one broad aspect the present invention provides an exercise machine comprising a patient support platform having first and second parts adapted to support the upper and lower parts of a patient's body, means for applying a cyclic movement to said first and second parts, a support means pivotally coupled to each of said first and second parts and adjustment means whereby the position of pivotal coupling of each support means to the respective first and second parts can be individually adjusted relative to at least one reference plane.

In the preferred form of the invention the position of pivotal coupling is adjustable relative to first and second reference planes. The first reference plane is preferably the horizontal and the second plane is preferably vertical and parallel to the axis of the pivotal couplings.

According to the preferred form of the invention adjacent portions of the first and second parts are pivotally coupled to a movable member, said movable member being coupled to driving means whereby a reciprocal movement is applied to the moving member. The support means can be formed by telescopic members with the extent of telescopic adjustment being preferably achieved by linear actuators. The telescopic members are preferably coupled to position adjustment means whereby the position of the telescopic members can be adjusted and preferably in unison.

BRIEF DESCRIPTION OF THE DRAWINGS

FIG. 8 is a representation of an example of a chart which can be fixed to the machine showing the motion achieved by each part of the support platform at various settings.

DESCRIPTION OF THE PREFERRED EMBODIMENTS

Figure 1:
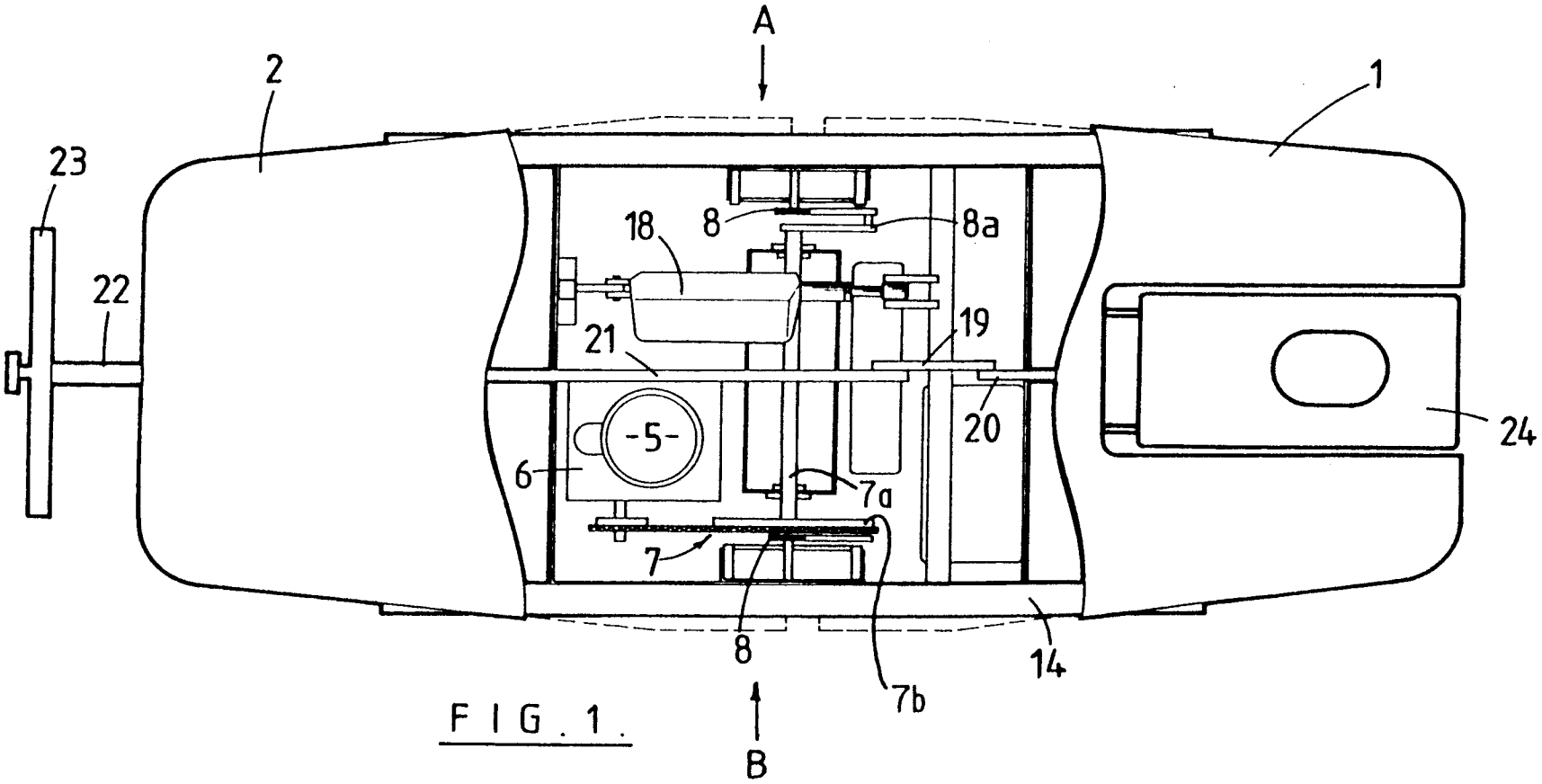
FIG. 1 is a plan view of the exercise machine according to the present invention but with the patient support platforms partially cut away.

The machine according to the illustrated form of the invention incorporates a padded platform forming a patient support surface. The platform is divided into two separate parts which form a head end section 1 and a foot end section 2. Each of sections 1 and 2 is pivotally connected via pivots 3 to a center column 4 which is mounted for reciprocating vertical movement relative to the base 14 of the machine. This movement is derived from an electric motor 5 coupled to a reduction gearbox 6 which via a chain and sprocket drive 7 rotates shaft 7*a*. At the end of shaft 7*a* remote from sprocket 7*b* a lever 8*a* is coupled to a crank 8. The crank 8,8 is also coupled to sprocket 7*b* (see FIG. 2). Cranks 8,8 are in turn coupled to center column 4. This drive arrangement causes center column 4 to rise and fall a prescribed distance in a certain time period. In the preferred form of the invention the rise and fall is 150 MM eight times per minute.

Head end section 1 is fixedly attached to an understructure 9. Foot end section 2 is similarly carried by an understructure 10, however, the platform itself is mounted for sliding movement on the understructure 10 and thus is capable of sliding movement in the order of 150 MM.

Each of understructures 9 and 10 are pivotally mounted at 11 to respective supports 12 and 13. These supports 12 and 13 are each pivotally coupled at their lower ends to the base 14 of the machine. Supports 12 and 13 are capable of adjustment in two directions. They are telescopic thus can be lengthened or shortened (in the order of 150 MM). Also, as they are pivotally coupled to base 14 the upper ends of the supports (and thus pivot couplings 11) can be adjusted either toward or away from the center of the machine thereby changing the fulcrum point on which the head and foot end sections 1 and 2 pivot. These two adjustments provide for more or less motion of each platform section and allow this movement to be disposed as required above and below the horizontal (the base 14 considered to be located on the horizontal). The length adjustment thus disposes the platform movement to a higher or lower level while the adjustment of the fulcrum point increases or decreases platform movement.

These two adjustments can be achieved manually. However, they are preferably both controlled by electric linear actuators. To this end linear actuators 15 are respectively coupled to each support member 12 and 13. Each of supports 12 and 13 are of telescopic construction having a first lower tubular member 16 which is pivotally mounted at its lowermost end to base 14 and an upper inner member 17 which is pivotally coupled to the understructure of the platform sections at pivot 11. Thus the bodies of linear actuators 15 are located adjacent lower member 16 while the piston rod end thereof are coupled to inner member 17.

Figure 2:
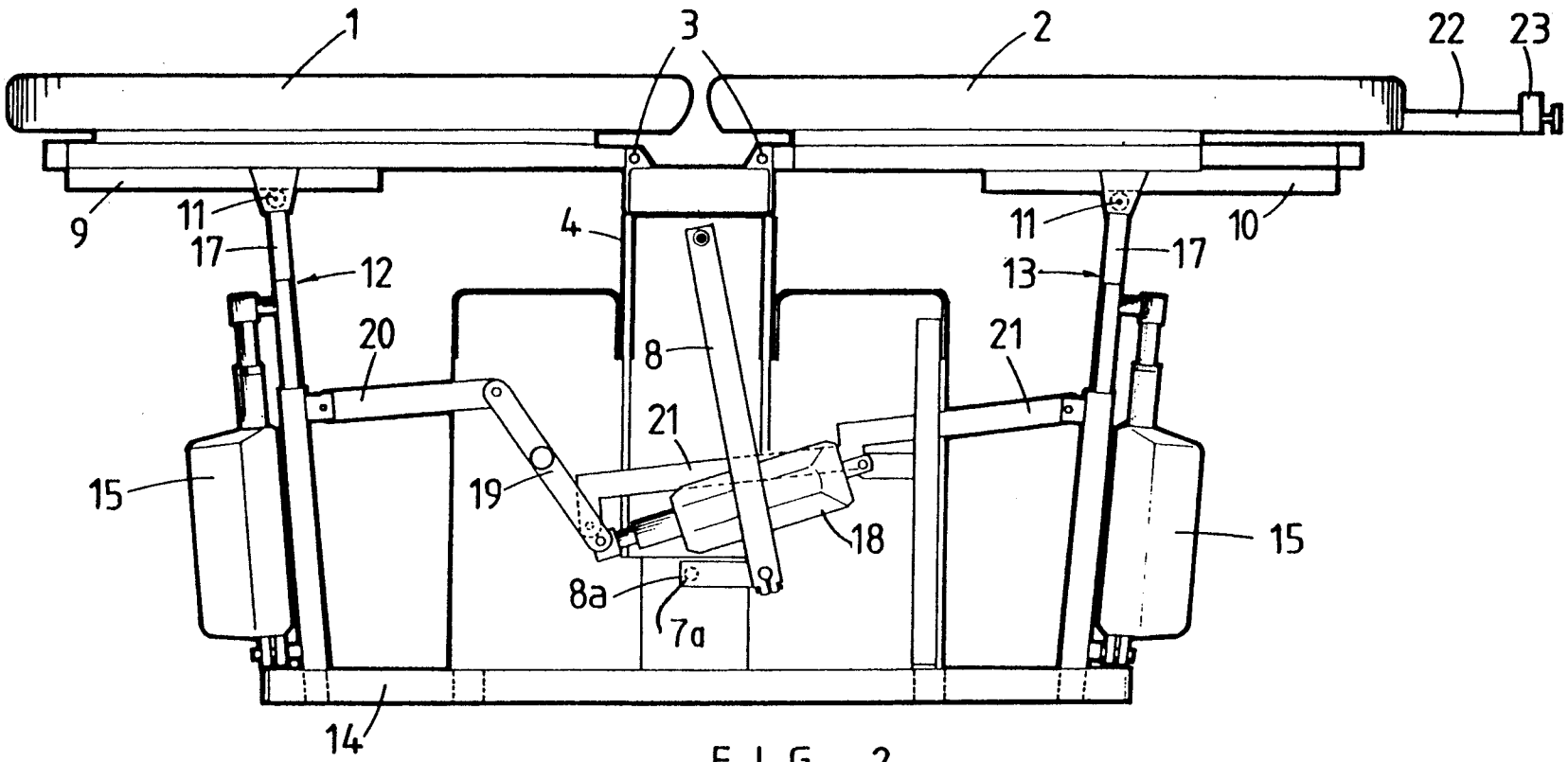
FIG. 2 is an elevational view in the direction of arrow A but with a side panel removed.
Figure 3:
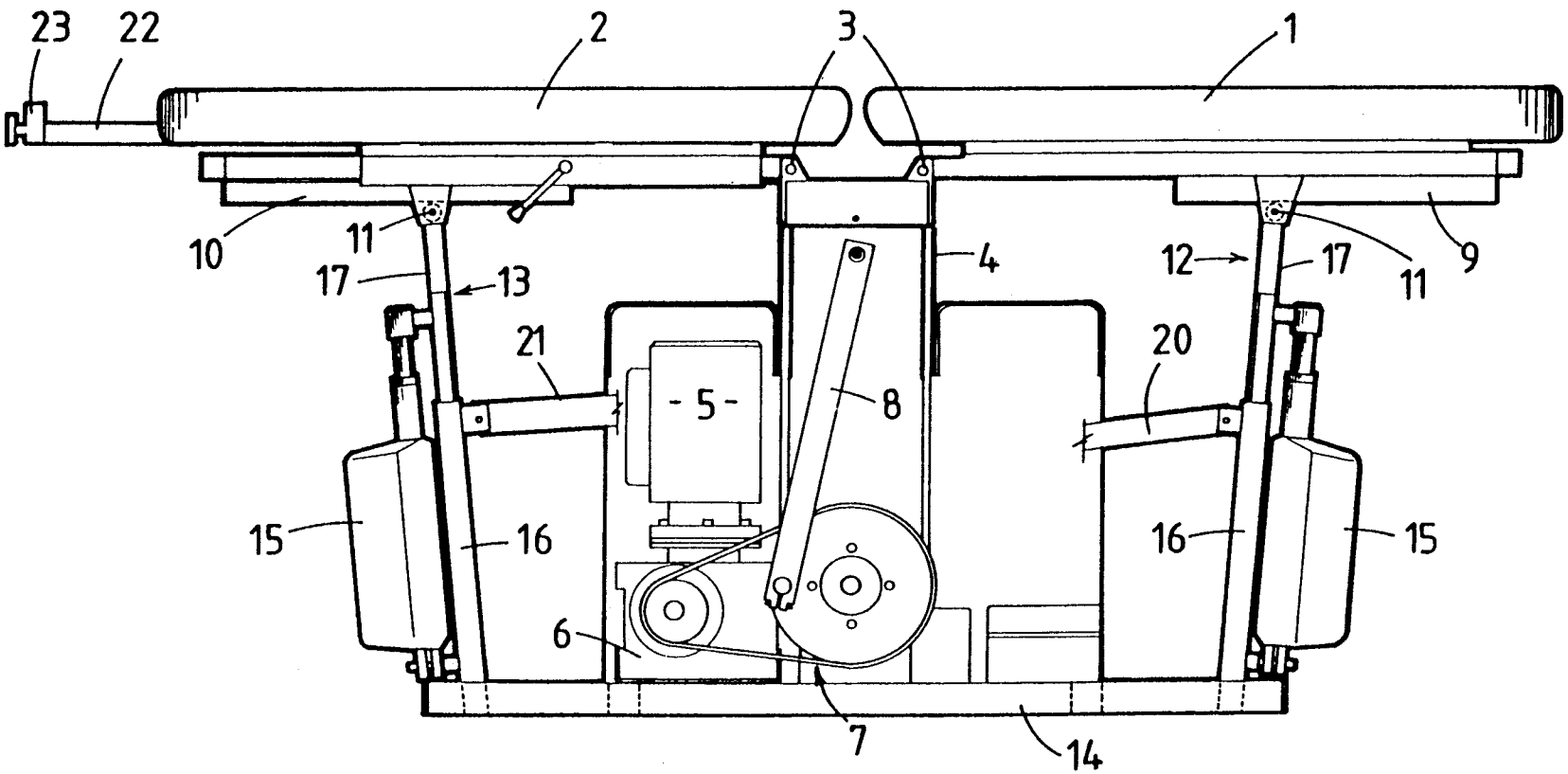
FIG. 3 is an elevational view in the direction of arrow B with a side panel removed.

A further linear actuator 18 is located within the machine enclosure and this actuator 18 is coupled via links 19, 20 and 21 to the lower member 16 of supports 12 and 13. As shown in FIG. 2 movement of the piston rod of linear actuator 18 causes links 19, 20 and 21 to move in unison toward or away from the center of the machine.

The adjustment via supports 12 and 13 causes each end section of the support platform to articulate downwardly or upwardly from the nominal horizontal. Thus according to a preferred form of the invention articulation downwards is by 25° while articulation in the upward direction is by 29°. Movement of end sections 1 and 2 can be adjusted via the fulcrum adjustment from 15° to 28° giving a combined angular movement of 30° to 56°.

When the therapist decides on the appropriate treatment to be given it is important that the therapist has absolute control over the location of the patient on the machine, the degree of articulation to be induced and the increased amount of articulation to be applied during treatment. Each of these factors must be able to be recorded so as to achieve a state of progression through the treatment or subsequent treatments. According to the preferred embodiment of the present invention the machine incorporates a numerical system that makes this possible.

A telescopic member 22 is provided at the outer end of foot end section 2. This telescopic member 22 includes a bar 23 which is engageable with the instep of the patient's feet when the patient is located on the support surfaces 1 and 2. The telescopic member 22 is graduated (preferably both in inches and centimeters) from the center point of the articulating platform. Accordingly a measurement taken from the floor to the level of the spine of the patient requiring treatment can be set on telescopic member 22 such that when the patient is in position on the machine and his or her feet engage with bar 23 the patient's spine can be precisely located for correct treatment. This particular measurement would be recorded on the patient's chart so that the patient can be correctly located at subsequent treatments.

Figure 4:
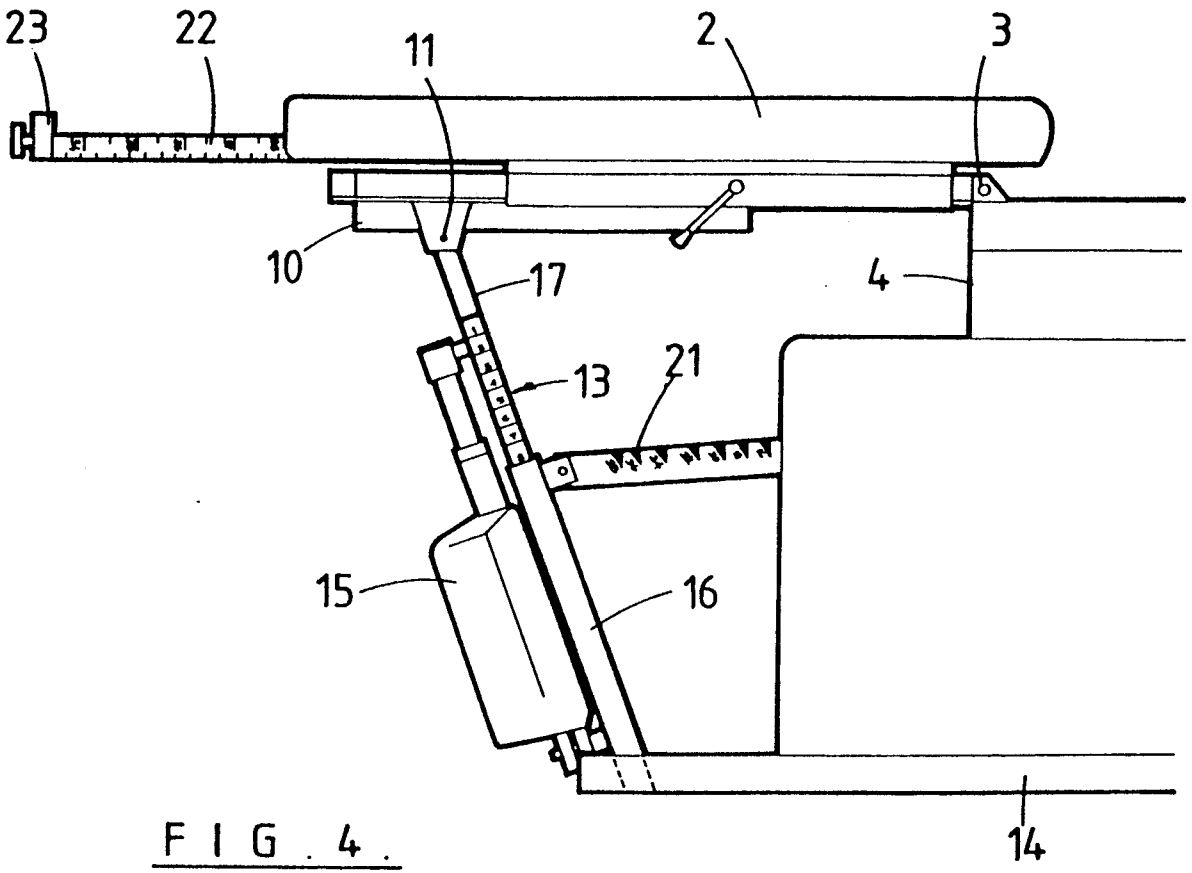
FIG. 4 is a partial elevational view of the foot end of the machine.

As shown in FIG. 4 each support member 12 and 13 has a vertical scale marked on its telescopic upper section 17. The vertical scale is numbered 1 to 8 with setting 1 being the minimum setting and 8 being the maximum setting when the support member is extended to its maximum allowable amount (in the preferred form 150 MM). Thus the extent to which the telescopic member 17 is extended can be readily adjusted via linear actuators 15 and the number indicating the adjustments for both foot end and head end settings will appear on the patient's chart. The therapist may decide to raise the foot end less than the head end. For instance, the therapist may set supports 12 and 13 at settings 3 and 6 thereby giving a maximum rise of 22° at the head end and 10° at the foot end (see the chart appearing in FIG. 8).

Links 20 and 21 which control the fulcrum point of the head and foot end sections are also provided with a scale which provides readings and degrees of articulation. Thus the therapist may begin therapy at 15° of movement and during treatment increase this to say 20°. Such adjustment is achieved via the operation of linear actuator 18 so that the links are extended in unison to setting 15 as shown in FIG. 4.

In accordance with the above the patient's record therefore would indicate as linear measurements 3–6 showing foot and head end difference and 15–20 being the degree of articulation at the start and completion of treatment.

These visual numerical settings provide for accuracy of treatment and in particular accurate progressive treatment. It will be appreciated that these adjustments can be automated. For example, with potentiometers installed with the linear actuators 15 and 18, adjustments to the machine necessary for individual patients and the amount of increased movement during treatment can be controlled by computer means.

Manipulative treatment often causes initial pain but this can decrease as the treatment progresses. The machine can thus be controlled to follow the threshold of pain and gradually increase the degree of articulation. The fulcrum points move in unison from the single linear actuator 18 and thus as they withdraw articulation of the platform increases. This adjustment can be made during therapy by the therapist or by a suitably programmed computer control.

With the machine in motion the patient's body bends at a higher level than the pivot points of the support surfaces 1 and 2 and linear differences therefore occur. This movement is dissipated by the movable nature of the foot end section 2. Because the upper body weight of a patient predominates the patient's chest remains in place on the head end platform 1 while the foot end 2 being located to the patient's feet slides back and forth. Any minor movement of the upper body which does occur is generally dissipated through frontal body tissue. The patient's face is supported on a low level headrest 24 which is mounted such as to slide back and forth.

Figure 5:
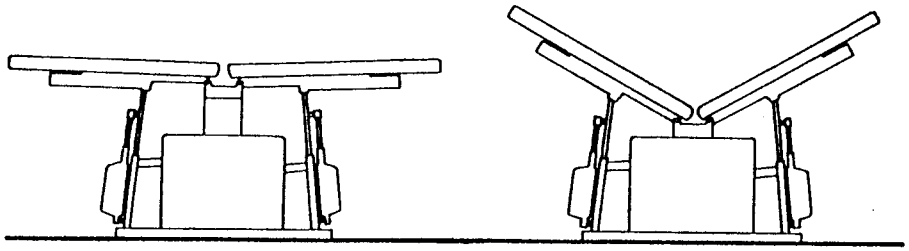
FIGS. 5–7 are illustrations of the machine when adjusted to provide differing degrees of movement of the first and second parts of the support platform.
Figure 6:
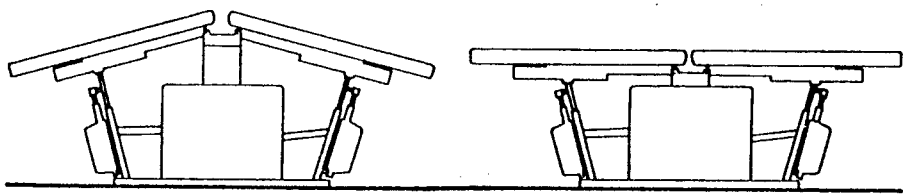
Figure 7:
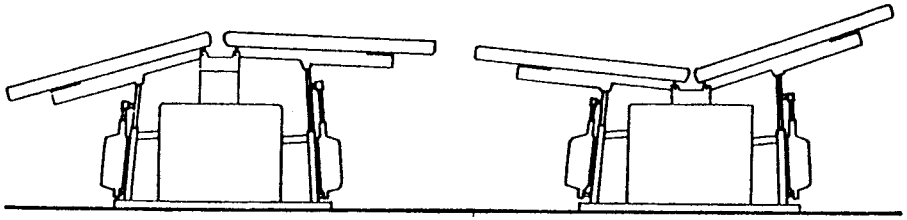

Referring now to FIGS. 5, 6 and 7 there are illustrated different degrees of articulation and movement which are achievable via suitable adjustment of the machine.

FIG. 5 shows the articulation achieved when the support members 12 and 13 are adjusted to 8 on the scale and the fulcrum scale is adjusted to 28°. The left hand view shows center column 4 at maximum stroke while the right hand view shows the column at minimum stroke. As a result platform sections 1 and 2 move from 1° above horizontal (left hand view) to 29° (right hand view). The arrangement shown in FIG. 5 illustrates the most acute extension movement that can be applied.

In FIG. 6 the support member scales are set at 1 and the fulcrum scales at 15°. When the center column 4 is at maximum stroke (left hand illustration) the platform sections slope downward at 17° while at minimum stroke (right hand view) they slope downwards at 2°. This setting applies the minimum flexion movement below horizontal, i.e. 15°. This can be increased to 25° by adjusting the fulcrum scale to 28°.

FIG. 7 provides an illustration of different support member settings at each end. In this instance the foot end support member 13 is set at 2 and the head end support member 12 is set at 7 with the fulcrum setting being at 22°. Consequently both of foot and head ends articulate 22° but the foot end measurement is substantially below horizontal and the head end substantially above horizontal. The foot end moves from −17° to +5° flexion while the head end moves from −2° flexion to +20° extension.

FIG. 8 is an illustration of a chart which would be fixed with the machine to show the motion achieved by each support section at the various settings.

The machine according to the present invention provides a means of repeatedly bending a patient's spine in extension or flexion while all motor control of the patient is in a relaxed state i.e. passive exercise. The motion applied by the machine can be adjusted manually or via computer control to be predominantly above or below horizontal. Each end can be separately adjusted to articulate at higher or lower levels. The degree of articulation can be increased or decreased during treatment. Thus end range passive exercise is achieved by use of the machine.

Thus the machine can provide appropriate lengths of therapy without muscular effort from the patient. The exercise achieved on the machine is therefore more beneficial than that which can be achieved during short periods of therapy or exercise programs carried out by the patient.

Obviously, numerous modifications and variations of the present invention are possible in light of the above teachings. It is therefore to be understood that within the scope of the appendant claims, the invention may be practised otherwise than as specifically described herein.

What is claimed is:

1. An exercise machine, which comprises:

a base;

first and second platform parts supported on said base, said platform parts forming a patient support platform for supporting the upper and lower parts of a patient's body;

moving means;

a reciprocatingly movable element pivotally coupled to adjacent ends of said platform parts and drivingly connected to said moving means whereby said movable element is reciprocatingly movable in a direction generally normal to said base above which the platform parts are supported and thereby apply a cyclic movement to said first and second platform parts;

a support member pivotally coupled between each of said first and second platform parts and said base;

adjustment means for adjusting the angular position of each support member relative to said base so as to adjust the position of the pivot coupling of said support member to the platform part relative to the pivot coupling of the platform part to the movable element, and means for maintaining the angular disposition of each support member relative to said base substantially fixed against any substantial movement during cyclic movement being applied to the platform parts.

2. An exercise machine as claimed in claim 1 wherein the distance between the pivot coupling said support member to said base and said platform part is adjustable.

3. An exercise machine as claimed in claim 2 wherein of each support member is adjustable in length.

4. An exercise machine as claimed in claim 3 wherein each support member is of telescopic construction.

5. An exercise machine as claimed in claim 4 wherein the extent of telescopic adjustment of each support member is controlled by a linear actuator.

6. An exercise machine as claimed in claim 3 wherein each support member is independently adjustable in length.

7. An exercise machine as claimed in claim 1 wherein said adjustment means is coupled via connecting means to each support member such that it adjusts in unison the angle which each support member makes with said base, said adjustment means also including said means for maintaining the angular disposition of the support member in said substantially fixed position.

8. An exercise machine as claimed in claim 1 wherein said support member and said adjustment means each provide visual indications relative to datum points such that predetermined adjustments thereof can be effected by reference to said visual indications.

9. An exercise machine as claimed in claim 1 wherein said second platform part is slidingly mounted to a substructure which is in turn pivotally coupled to the support member.

10. An exercise machine, which comprises:

a patient support platform having first and second parts adapted to support the upper and lower parts of a patient's body, a movable member pivotally attached to adjacent parts of said first and second parts, a reciprocatingly movable element for applying a reciprocating movement to said movable member in a direction substantially normal to a plane defined by the support platform when said first and second parts are aligned end to end, an elongate support pivotally coupled to each of said first and second platform parts at a point which is spaced from the pivotal attachment of each platform part to the movable member.

adjustment means for adjusting the angle of each support relative to the part to which it is attached such that the point of pivotal coupling of each support to said part is adjusted relative to a pivot coupling of said part to said movable element, and means for holding said support fixed against any substantial movement during said reciprocating movement of said movable member.

11. An exercise machine as claimed in claim 10 wherein each support comprises a first element coupled via said pivotal coupling to each said platform part and slidingly engaged with a second element wherein said second element is pivotally coupled to a base, and control means for controlling adjustment of the relative positions of the first and second elements to thereby adjust the distance of the pivot coupling between the first element and platform part relative to said base and thereby adjust the angle of said platform part relative to said plane.

12. An exercise machine as claimed in claim 11 which comprises a first control member wherein one of said first and second elements is coupled to said control member, and further control means for controlling adjustment of the angle of the support relative to the base and thereby effect adjustment of the position of the pivot coupling of said support to the platform part to which it is pivotally coupled relative to said direction of movement.

13. An exercise machine as claimed in claim 12 wherein said support and the control member include visual markings which, relative to a respective datum point, provide a visual indication of adjustments which translate into the extent of movement of the platform part relative to said plane.

14. An exercise machine as claimed in claim 12 which comprise a substructure wherein said second part is slidingly mounted to said substructure which is in turn coupled to a said support.

15. An exercise machine as claimed in claims 1 or 10 wherein the second platform part includes, at an end thereof remote from that which is pivotally coupled to said movable member, an engagement element which is engageable with the feet of a patient, wherein the position of said engagement element is adjustable relative to said remote end.

16. An exercise machine as claimed in claim 15 wherein said engagement element includes a support element which is slidingly engaged with said second platform part, said support element including visual markings to provide a visual indication of adjustment of the position of the engagement element relative to a datum point.

* * * * *